US011828466B2

(12) United States Patent
Salazar Lois et al.

(10) Patent No.: US 11,828,466 B2
(45) Date of Patent: Nov. 28, 2023

(54) COMBUSTOR SWIRLER TO CMC DOME ATTACHMENT

(71) Applicant: General Electric Company, Schenectady, NY (US)

(72) Inventors: Gerardo Antonio Salazar Lois, West Chester, OH (US); Daniel J. Kirtley, Blue Ash, OH (US); Nicholas John Bloom, Maineville, OH (US); Shai Birmaher, Cincinnati, OH (US); Ryan Christopher Jones, West Chester, OH (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 24 days.

(21) Appl. No.: 17/499,085

(22) Filed: Oct. 12, 2021

(65) Prior Publication Data

US 2023/0114116 A1 Apr. 13, 2023

(51) Int. Cl.

| | |
|---|---|
| ***F23R 3/60*** | (2006.01) |
| ***F23R 3/16*** | (2006.01) |
| ***F23R 3/00*** | (2006.01) |

(52) U.S. Cl.

CPC ..... *F23R 3/16* (2013.01); *F23R 3/007* (2013.01); *F23R 3/60* (2013.01); *F23R 2900/00017* (2013.01)

(58) Field of Classification Search

None

See application file for complete search history.

(56) References Cited

U.S. PATENT DOCUMENTS

| | | | | |
|---|---|---|---|---|
| 2,252,132 A * | 8/1941 | Mazveskas | ..... | A63C 17/22 285/402 |
| 5,285,632 A * | 2/1994 | Halila | ..... | F23R 3/10 60/753 |
| 6,212,870 B1 * | 4/2001 | Thompson | ..... | F23R 3/60 60/746 |
| 6,581,386 B2 | 6/2003 | Young et al. | | |
| 7,591,136 B2 | 9/2009 | Bernier et al. | | |

(Continued)

FOREIGN PATENT DOCUMENTS

EP 3022491 B1 10/2019

OTHER PUBLICATIONS

Verrilli, Characterization of Ceramic Matrix Composite Fasteners Exposed in a Combustor Linear Rig Test, Jan. 2004, American Society of Mechanical Engineers Journal of Engineering for Gas Turbines and Power, vol. 126, 1-5.*

*Primary Examiner* — Steven M Sutherland

(74) *Attorney, Agent, or Firm* — Venable LLP; Edward A. Kmett; Michele V. Frank

(57) ABSTRACT

A combustor for a gas turbine includes a ceramic matrix composite (CMC) dome with a swirler mounting wall formed integral with the CMC dome, and a swirler assembly including a plurality of clevis dome attachment members for connecting the swirler assembly to the CMC dome. Bushings are arranged within a plurality of dome-side swirler assembly mounting openings of the swirler mounting wall, and the CMC dome is arranged within respective ones of the plurality of clevis dome attachment members of the swirler assembly. A swirler-dome connecting member is disposed through each of the clevis dome attachment members so as to mount the swirler assembly to the CMC dome.

20 Claims, 7 Drawing Sheets

(56) References Cited

U.S. PATENT DOCUMENTS

| | | | | |
|---|---|---|---|---|
| 7,596,949 | B2 | 10/2009 | DeVane et al. | |
| 10,317,085 | B2 | 6/2019 | Hannwacker et al. | |
| 10,598,381 | B2 | 3/2020 | Drake et al. | |
| 2008/0034759 | A1* | 2/2008 | Bulman | F02C 3/14 60/796 |
| 2010/0263194 | A1* | 10/2010 | Morrison | F16B 5/0266 29/889.22 |
| 2010/0326078 | A1* | 12/2010 | Pieussergues | F23R 3/60 60/740 |
| 2011/0271684 | A1* | 11/2011 | Corsmeier | F23R 3/42 60/753 |
| 2014/0003880 | A1* | 1/2014 | Grooms, II | F16B 35/00 411/378 |
| 2018/0238184 | A1* | 8/2018 | Reynolds | F01D 9/023 |
| 2018/0320900 | A1 | 11/2018 | Duncan et al. | |
| 2018/0347816 | A1* | 12/2018 | Dziech | F23R 3/002 |
| 2018/0363903 | A1* | 12/2018 | Dziech | F23R 3/007 |
| 2019/0003711 | A1* | 1/2019 | Reynolds | F23R 3/283 |
| 2020/0063961 | A1 | 2/2020 | Jones et al. | |
| 2020/0248903 | A1* | 8/2020 | Sampath | F23R 3/14 |
| 2021/0095711 | A1* | 4/2021 | Pinney | F16B 43/001 |

* cited by examiner

COMBUSTOR SWIRLER TO CMC DOME ATTACHMENT

TECHNICAL FIELD

The present disclosure relates to connecting a combustor swirler to a CMC (Ceramic Matrix Composite) dome in a gas turbine engine.

BACKGROUND

Some conventional gas turbine engines are known to include rich-burn combustors that typically use a metallic swirler assembly that is connected with a metallic dome structure. The metallic dome structure has been known to include a deflector wall on a combustion chamber side of the dome, where the deflector wall deflects heat generated in the combustor during combustion. Cooling holes are generally included through the dome structure so as to provide some surface cooling of the dome and deflector wall. The metallic swirler assembly is generally brazed to, or welded to, the dome structure.

BRIEF DESCRIPTION OF THE DRAWINGS

Features and advantages of the present disclosure will be apparent from the following description of various exemplary embodiments, as illustrated in the accompanying drawings, wherein like reference numbers generally indicate identical, functionally similar, and/or structurally similar elements.

DETAILED DESCRIPTION

Features, advantages, and embodiments of the present disclosure are set forth or apparent from a consideration of the following detailed description, drawings, and claims. Moreover, it is to be understood that the following detailed description is exemplary and intended to provide further explanation without limiting the scope of the disclosure as claimed.

Various embodiments are discussed in detail below. While specific embodiments are discussed, this is done for illustration purposes only. A person skilled in the relevant art will recognize that other components and configurations may be used without departing from the spirit and scope of the present disclosure.

As used herein, the terms "first", "second", and "third" may be used interchangeably to distinguish one component from another and are not intended to signify location or importance of the individual components.

The terms "upstream" and "downstream" refer to the relative direction with respect to fluid flow in a fluid pathway. For example, "upstream" refers to the direction from which the fluid flows, and "downstream" refers to the direction to which the fluid flows.

Some gas turbine engines include rich-burn combustors that typically use a metallic swirler assembly that is connected with a metallic dome structure. The metallic dome structure has been known to include a deflector wall on a combustion chamber side of the dome, where the deflector wall deflects heat generated in the combustor during combustion. Cooling holes are generally included through the dome structure so as to provide some surface cooling of the dome and deflector wall. The metallic swirler assembly is generally brazed to, or welded to, the dome structure.

The implementation of non-metallic materials in combustors is becoming more prevalent. In particular, the implementation of Ceramic Matrix Composite (CMC) materials can be used to form the dome structure, rather than utilizing the conventional metallic dome structures. The CMC materials have better thermal capabilities than the conventional metallic materials, and, as a result, less cooling is required for a CMC dome than is required for the conventional metallic dome. The less cooling needed for the dome means that more air is available for other purposes, including being used as dilution air. In addition, the CMC dome structure does not require a deflector wall, thereby reducing the overall axial length of the dome, which also reduces the length of the combustor module. The implementation of the CMC dome with a metallic swirler, however, presents a challenge as to the ability to connect the metallic swirler to the CMC dome, and to provide for a thermal decoupling between the metallic swirler assembly and the CMC dome. The present disclosure provides a clevis joint attachment technique to connect the metallic swirler to the CMC dome so as to thermally decouple the swirler assembly from the CMC dome.

Figure 1:
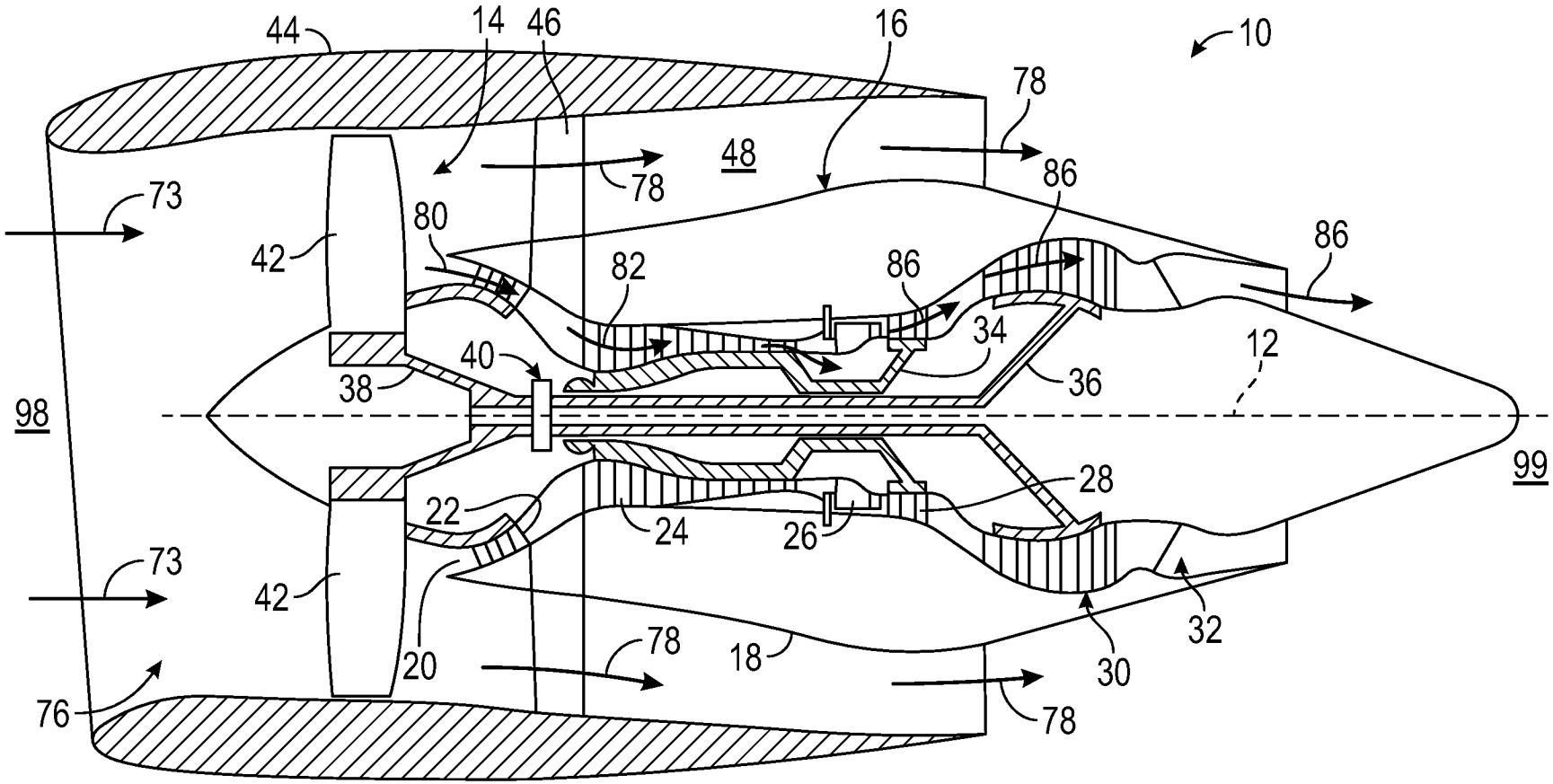
FIG. 1 is a schematic partial cross-sectional side view of an exemplary high by-pass turbofan jet engine, according to an aspect of the present disclosure.

Referring now to the drawings, FIG. 1 is a schematic partial cross-sectional side view of an exemplary high by-pass turbofan jet engine 10, herein referred to as "engine 10," as may incorporate various embodiments of the present disclosure. Although further described below with reference to a ducted turbofan engine, the present disclosure is also applicable to turbomachinery in general, including turbojet, turboprop, and turboshaft gas turbine engines, including marine and industrial turbine engines and auxiliary power units. In addition, the present disclosure is not limited to ducted fan type turbine engines such as that shown in FIG. 1, but can be implemented in unducted fan (UDF) type turbine engines. As shown in FIG. 1, engine 10 has an axial centerline axis 12 that extends therethrough from an upstream end 98 to a downstream end 99 for reference purposes. In general, engine 10 may include a fan assembly 14 and a core engine 16 disposed downstream from the fan assembly 14.

The core engine 16 may generally include an outer casing 18 that defines an annular inlet 20. The outer casing 18 encases, or at least partially forms, in serial flow relationship, a compressor section (22/24) having a booster or low pressure (LP) compressor 22, a high pressure (HP) compressor 24, a combustor 26, a turbine section (28/30) including a high pressure (HP) turbine 28 and a low pressure (LP) turbine 30, and a jet exhaust nozzle section 32. A high pressure (HP) rotor shaft 34 drivingly connects the HP turbine 28 to the HP compressor 24. A low pressure (LP) rotor shaft 36 drivingly connects the LP turbine 30 to the LP compressor 22. The LP rotor shaft 36 may also be connected to a fan shaft 38 of the fan assembly 14. In particular embodiments, as shown in FIG. 1, the LP rotor shaft 36 may be connected to the fan shaft 38 by way of a reduction gear 40, such as in an indirect-drive or a geared-drive configuration. In other embodiments, although not illustrated, the engine 10 may further include an intermediate pressure (IP) compressor and a turbine rotatable with an intermediate pressure shaft.

As shown in FIG. 1, the fan assembly 14 includes a plurality of fan blades 42 that are coupled to, and extend radially outwardly from, the fan shaft 38. An annular fan casing or nacelle 44 circumferentially surrounds the fan assembly 14 and/or at least a portion of the core engine 16. In one embodiment, the nacelle 44 may be supported relative to the core engine 16 by a plurality of circumferentially spaced outlet guide vanes or struts 46. Moreover, at least a portion of the nacelle 44 may extend over an outer portion of the core engine 16 so as to define a bypass airflow passage 48 therebetween.

Figure 2:
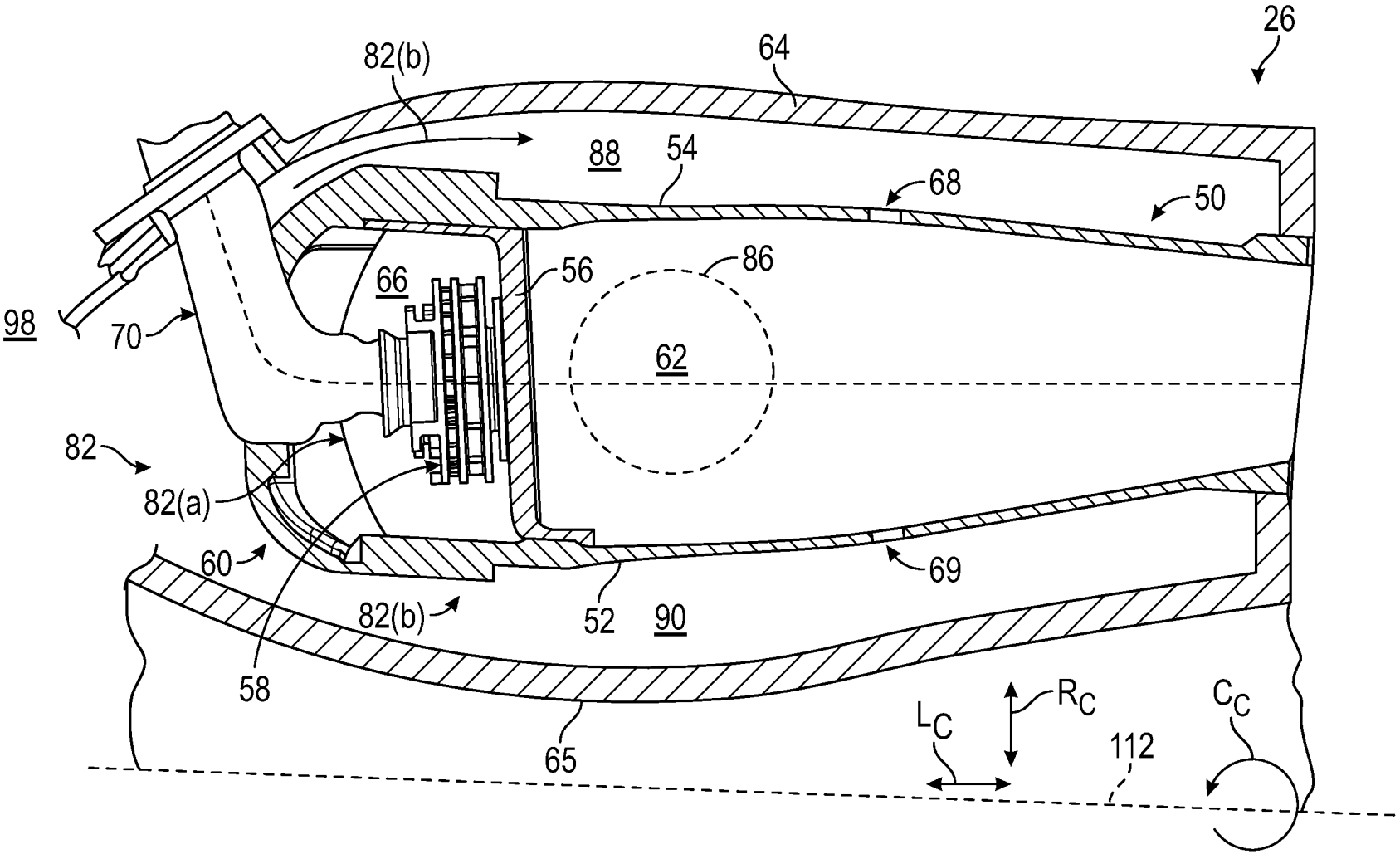
FIG. 2 is a partial cross-sectional side view of an exemplary combustor, according to an aspect of the present disclosure.

FIG. 2 is a cross-sectional side view of an exemplary combustor 26 of the core engine 16 as shown in FIG. 1. FIG. 2 depicts a combustor axial centerline 112 that may generally correspond to the engine axial centerline axis 12. Thus, the combustor 26 of FIG. 2 defines a combustor longitudinal direction ($L_C$) corresponding to the combustor axial centerline 112, a combustor radial direction ($R_C$) extending outward from the combustor axial centerline 112, and a combustor circumferential direction ($C_C$) extending circumferentially about the combustor axial centerline 112. As shown in FIG. 2, the combustor 26 may generally include a combustor liner 50, having an inner liner 52 and an outer liner 54. Each of the inner liner 52 and the outer liner 54 are annular liners that extend circumferentially about the combustor axial centerline 112. A Ceramic Matrix Composite (CMC) dome 56 extends in the combustor radial direction $R_C$ between the inner liner 52 and the outer liner 54, and also extends circumferentially about the combustor axial centerline 112. Together, the inner liner 52, the outer liner 54, and the CMC dome 56 define a combustion chamber 62 therebetween. In the combustion chamber 62, an initial chemical reaction of an ignited fuel-oxidizer mixture injected into the combustion chamber 62 by a swirler assembly 58 may occur to generate combustion gases 86. The combustion gases 86 then flow further downstream into the HP turbine 28 and the LP turbine 30 (FIG. 1). While FIG. 2 depicts a single swirler assembly 58, it can be appreciated that a plurality of the swirler assemblies 58 are present in the combustor 26, where the respective swirler assemblies 58 are circumferentially spaced apart from one another about the combustor axial centerline 112.

The combustor 26 further includes an outer casing 64 that extends circumferentially about the combustor axial centerline 112, and an inner casing 65 that also extends circumferentially about the combustor axial centerline 112. An outer flow passage 88 is defined between the outer casing 64 and the outer liner 54, and an inner flow passage 90 is defined between the inner casing 65 and the inner liner 52. The outer liner 54 may also include a plurality of outer liner dilution openings 68 that are circumferentially spaced around the outer liner 54. Similarly, the inner liner 52 may include a plurality of inner liner dilution openings 69 that are circumferentially spaced around the inner liner 52.

Referring back to FIG. 1, in operation, air 73 enters the nacelle 44 at a nacelle inlet 76, and a portion of the air 73 enters the compressor section (22/24) as a compressor inlet air flow 80, where it is compressed. Another portion of the air 73 enters the bypass airflow passage 48, thereby providing a bypass airflow 78. In FIG. 2, compressed air 82 from the compressor section (22/24) enters the combustor 26 via a diffuser (not shown). A portion of the compressed air 82(*a*) enters a cowl 60 into a pressure plenum 66, while another portion of the compressed air 82(*b*) passes to the outer flow passage 88 and to the inner flow passage 90. The compressed air 82(*a*) in the pressure plenum 66 passes through the swirler assembly 58 to mix with fuel injected by a fuel nozzle assembly 70 and is ignited to generate combustion gases 86. A portion of the compressed air 82(*b*) in the outer flow passage 88 may be used as dilution air provided to the combustion chamber 62 through the plurality of outer liner dilution openings 68, and another portion of the compressed air 82(*b*) in the inner flow passage 90 may also be used as dilution air provided to the combustion chamber 62 through the plurality of inner liner dilution openings 69.

Figure 3:
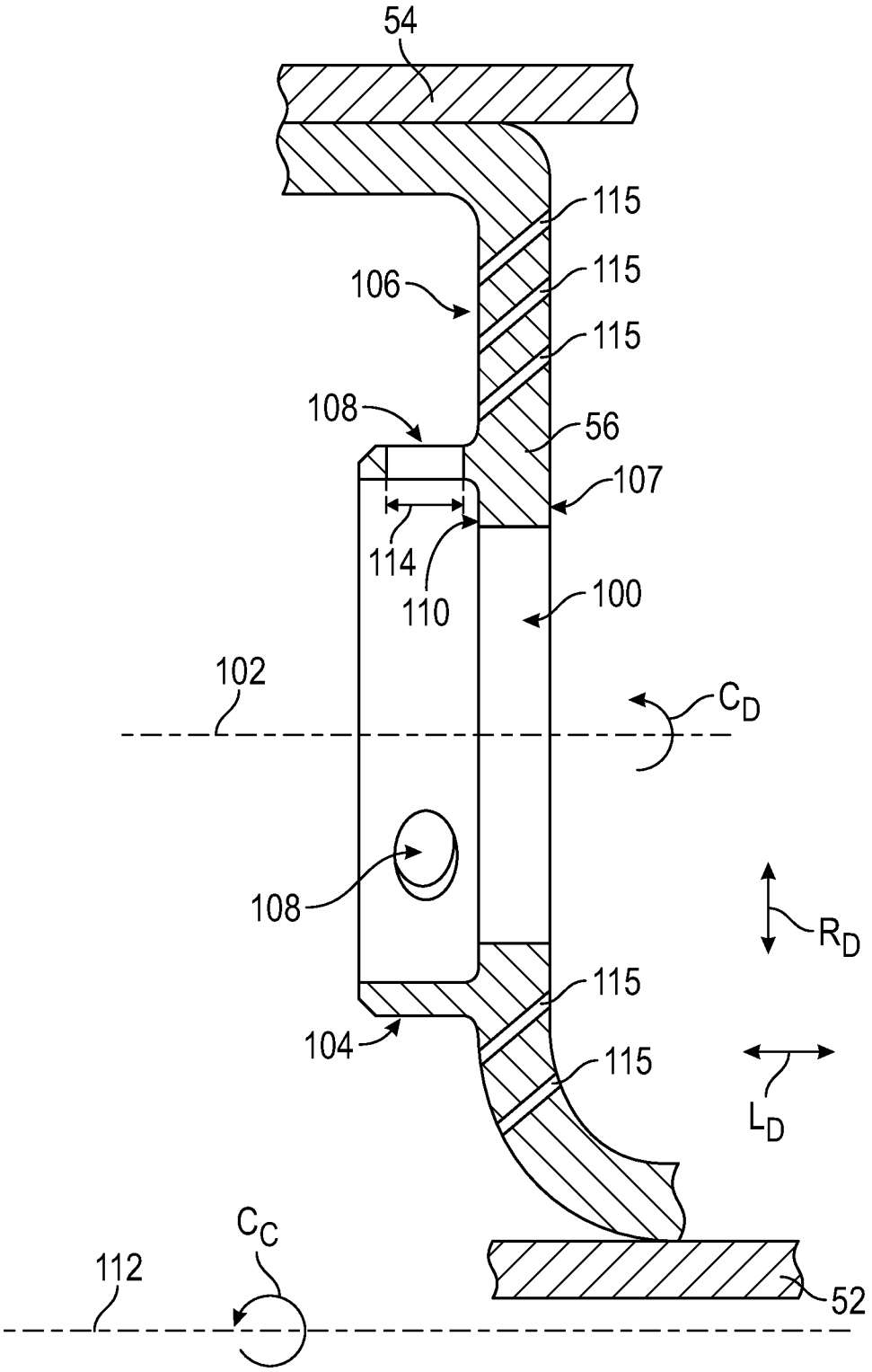
FIG. 3 is a partial cross-sectional side view of an exemplary CMC dome structure, according to an aspect of the present disclosure.

FIG. 3 depicts a partial cross-sectional view of the CMC dome 56, according to an aspect of the present disclosure. The CMC dome 56, as was mentioned above, extends circumferentially ($C_C$) about the combustor axial centerline 112. The CMC dome 56 is suitably connected (connection not shown) to the outer liner 54 and to the inner liner 52. The CMC dome 56 includes a swirler assembly opening 100 (see also, FIG. 6) through the CMC dome 56, where the swirler assembly opening 100 defines a CMC opening centerline 102 therethrough. The CMC opening centerline 102 defines a CMC opening longitudinal direction ($L_D$), a CMC opening radial direction ($R_D$) extending outward from the CMC opening centerline 102, and a CMC opening circumferential direction ($C_D$) extending circumferentially about the CMC opening centerline 102. It can be appreciated that, while FIG. 3 depicts a single swirler assembly opening 100, a plurality of the swirler assembly openings 100 may be circumferentially spaced about the CMC dome 56. Thus, a plurality of the swirler assemblies 58 (FIG. 2) may be connected to the CMC dome 56, as will be described below.

The CMC dome 56 also includes a swirler mounting wall 104, which may also have a CMC structure and may be formed integral with the CMC dome 56. The swirler mounting wall 104 extends circumferentially about the CMC opening centerline 102 and extends upstream in the CMC longitudinal direction $L_D$ from an upstream side 106 of the CMC dome 56. The swirler mounting wall 104 includes a plurality of dome-side swirler mounting openings 108 (see also FIG. 6) therethrough extending in the CMC opening radial direction $R_D$, and are circumferentially spaced apart from one another about the swirler mounting wall 104. The swirler mounting wall 104 may include, for example, two, three, or four dome-side swirler mounting openings 108 (see FIG. 6). Of course, the number of dome-side swirler mounting openings 108 is not limited to the foregoing, and any number may be implemented to provide a desired connection of the swirler assembly 58 (FIG. 2) with the CMC dome 56. The dome-side swirler mounting openings 108 are seen to generally be cylindrical holes through the swirler mounting wall 104, and a size 114 (e.g., diameter) of the dome-side swirler mounting openings 108 is generally arranged to accommodate a bushing therethrough (to be described below). The CMC dome 56 may optionally include a plurality of dome cooling passages 115 through the CMC dome 56. The CMC dome 56 is further seen to include a shoulder 110 extending in the CMC opening radial direction RD between the swirler assembly opening 100 and the swirler mounting wall 104. As will be described below, the dome-side swirler mounting openings 108 are utilized for mounting the swirler assembly 58 to the CMC dome 56, and the shoulder 110 is utilized for seating the swirler assembly 58 against the CMC dome 56.

Figure 4:
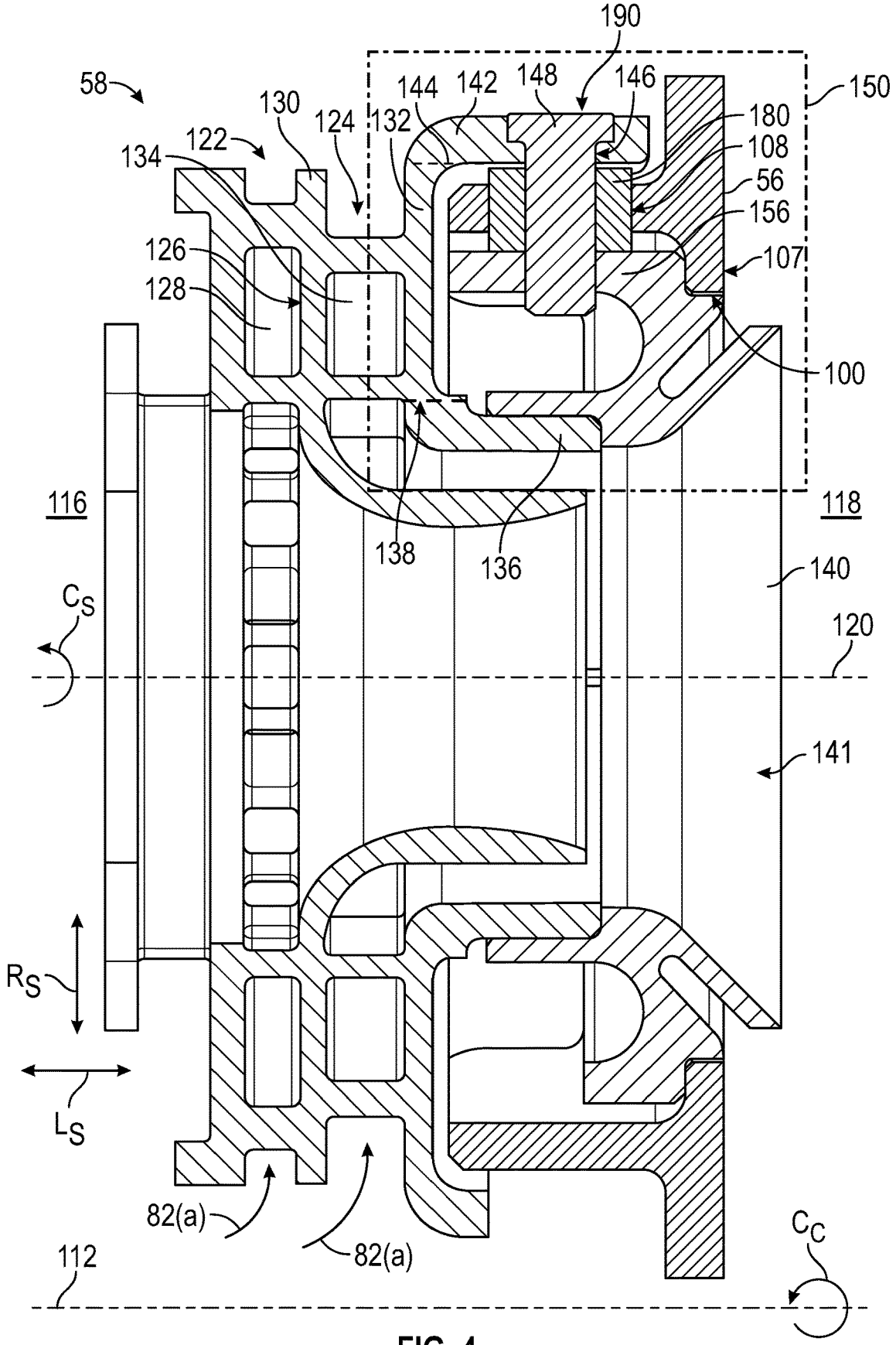
FIG. 4 is a partial cross-sectional side view swirler-CMC dome connection, according to an aspect of the present disclosure.

FIG. 4 depicts an example of a swirler assembly with a CMC dome connected thereto, according to an aspect of the present disclosure. In FIG. 4, the swirler assembly 58 can be seen to define a swirler assembly upstream direction 116 and a swirler assembly downstream direction 118. The swirler assembly 58 further defines a swirler centerline 120 that extends through the swirler assembly 58 in a swirler longitudinal direction ($L_S$). A swirler assembly radial direction ($R_S$) extends outward from the swirler centerline 120, and a swirler assembly circumferential direction ($C_S$) extends circumferentially about the swirler centerline 120. The swirler assembly 58 is generally a metallic swirler assembly, as compared with the CMC dome 56. That is, various component parts of the swirler assembly 58 are constructed of metal alloy materials that are more conducive to structural expansion due to increased temperatures within the combustor than the CMC material of the CMC dome 56.

The swirler assembly 58 includes a primary swirler 122, and a secondary swirler 124 connected to a downstream side 126 of the primary swirler 122. The primary swirler 122 includes a plurality of primary swirl vanes 128 that are circumferentially spaced about the swirler centerline 120 within the primary swirler 122. The primary swirl vanes 128 induce a radially inward swirl to compressed air 82(*a*) from the pressure plenum 66 (FIG. 2) passing through the primary swirler 122. The secondary swirler 124 includes an upstream radial wall 130 extending circumferentially about the swirler centerline 120, and a downstream radial wall 132 extending circumferentially about the swirler centerline 120. The secondary swirler 124 also includes a plurality of secondary swirl vanes 134 disposed between the upstream radial wall 130 and the downstream radial wall 132. The secondary swirl vanes 134 induce a radially inward swirl to the compressed air 82(*a*) passing through the secondary swirler 124 from the pressure plenum 66. The secondary swirler 124 further includes a flare connecting wall 136 extending circumferentially about the swirler centerline 120 and extending downstream in the swirler axial direction $L_S$ from a radially inner end 138 of the downstream radial wall 132. The flare connecting wall 136 is for connecting with a flare 140, as will be described below.

The secondary swirler 124 further includes a plurality of outer axial walls 142 extending downstream in the swirler axial direction $L_S$ from a radially outer end 144 of the downstream radial wall 132, and also extends in the swirler circumferential direction $C_S$. The plurality of outer axial walls 142 are circumferentially spaced about the swirler centerline 120. The number of the outer axial walls 142, and the circumferential spacing of the outer axial walls 142, are the same as that of the plurality of dome-side swirler mounting openings 108. Thus, as seen in FIG. 6, where the swirler mounting wall 104 of the CMC dome 56 includes three dome-side swirler mounting openings 108 equally spaced around the swirler mounting wall 104, the secondary swirler 124 includes three outer axial walls 142 that are also equally spaced circumferentially about the swirler centerline 120. Each outer axial wall 142 has an outer axial wall opening 146 (see also, FIG. 5) therethrough extending in the swirler radial direction $R_S$. The outer axial wall opening 146 may include a recess portion 152 (FIG. 5) to accommodate a swirler-dome connecting member 148. Thus, each of the plurality of outer axial walls 142 is more or less a lug (i.e., a plate having a hole, the hole being sized to fit a clevis pin).

Figure 5:
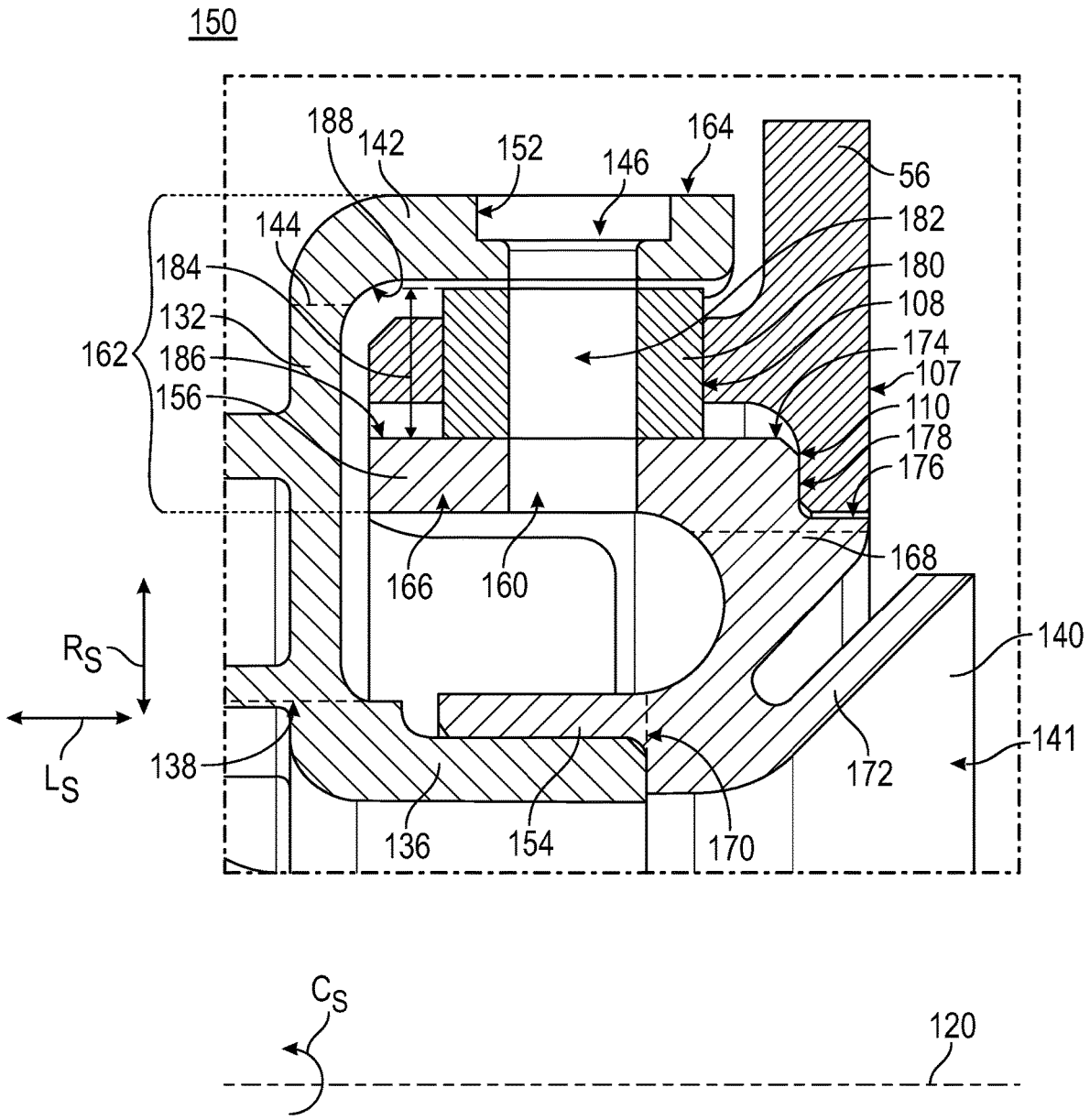
FIG. 5 is an enlarged partial cross-sectional view, taken at detail view 150 of FIG. 4, of an exemplary swirler-CMC dome connection, according to an aspect of the present disclosure.
Figure 6:
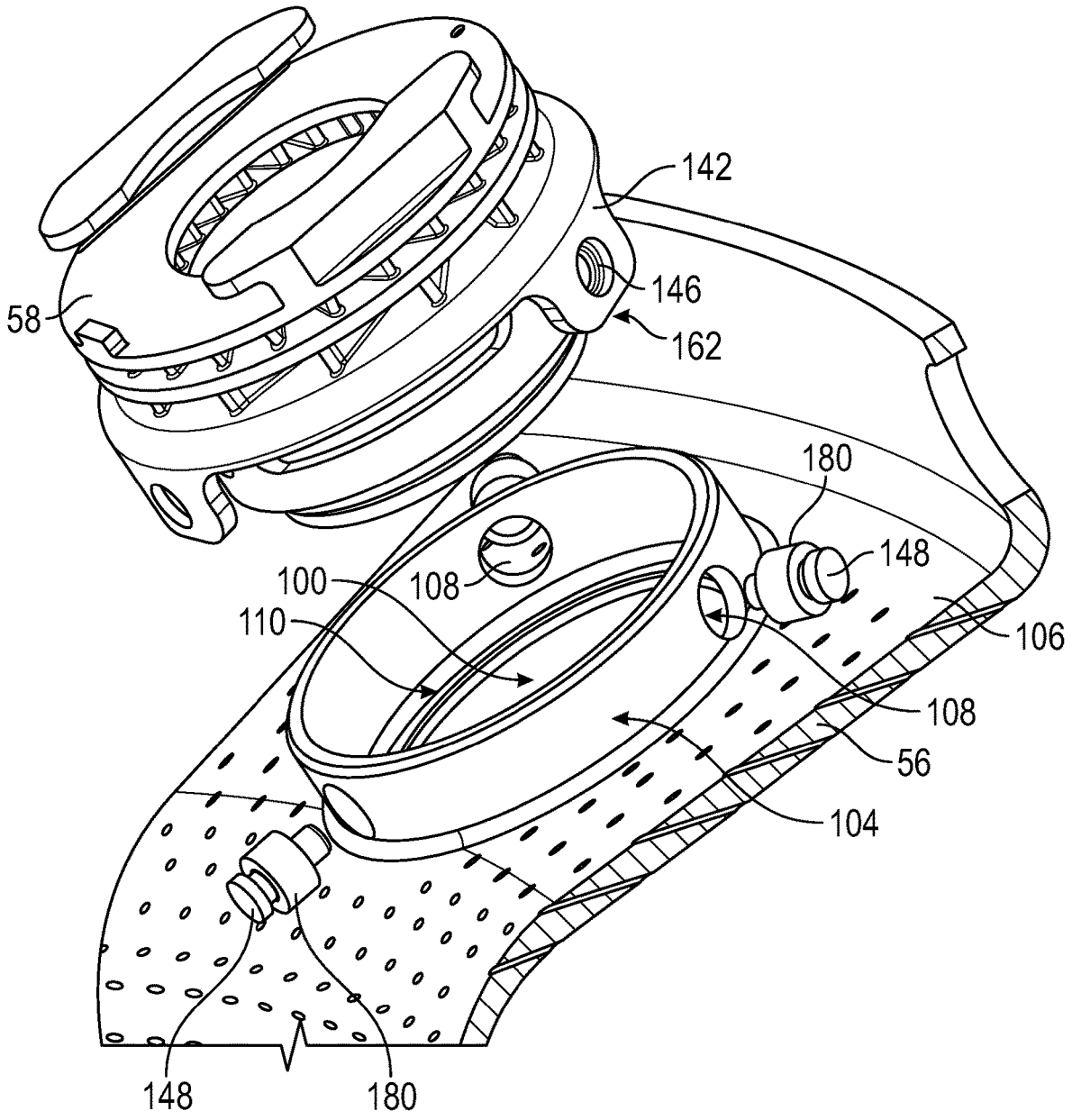
FIG. 6 is a forward aft-looking perspective view of a decoupled swirler assembly and CMC dome, according to an aspect of the present disclosure.

FIG. 5 is an enlarged view of a portion of FIG. 4 taken at detail view 150. In FIG. the swirler-dome connecting member 148 has been removed. The swirler assembly 58 includes the flare 140 that has an inner flare axial wall 154 extending in the swirler axial direction $L_S$ and extending circumferentially about the swirler centerline 120. The inner flare axial wall 154 is connected to the flare connecting wall 136 of the secondary swirler 124, such as by being brazed. The flare 140 also includes a flare end wall 168 that extends radially outward from a downstream end 170 of the inner flare axial wall 154 and extends circumferentially about the swirler centerline 120. The flare end wall 168 may define a flare cone or conical wall 172 that extends circumferentially about the swirler centerline 120. The conical wall 172 may define an outlet 141 of the swirler assembly 58 (FIG. 4), and may extend into the combustion chamber 62 (FIG. 2) beyond a downstream surface 107 of the CMC dome. A radially outer end 174 of the flare end wall 168 includes a step 176 that extends circumferentially about the swirler centerline 120, and forms a flare end wall radial surface 178.

The flare 140 also includes a plurality of outer flare axial walls 156. Each outer flare axial wall 156 extends upstream in the swirler longitudinal direction $L_S$ from the radially outer end 174 of the flare end wall 168, and also extends in the swirler circumferential direction $C_S$. Each outer flare axial wall 156 also includes an outer flare axial wall opening 160 therethrough extending in the swirler radial direction $R_S$. When the flare 140 is connected to the secondary swirler 124 (FIG. 4) by brazing the inner flare axial wall 154 and the flare connecting wall 136 of the secondary swirler 124, the outer axial wall opening 146 and the outer flare axial wall opening 160 are radially aligned with one another. Thus, each outer flare axial wall 156 is more or less a lug in which its opening 160 is aligned with the outer axial wall opening 146 of the outer axial wall 142 so as to form a clevis structure. That is, together, respective pairs of the outer axial wall 142 of the secondary swirler 124, and the outer flare axial wall 156 of the flare 140 define a respective clevis dome attachment member 162, where the outer axial wall 142 may correspond to a clevis outer portion 164 and the outer flare axial wall 156 may correspond to a clevis inner portion 166.

Referring still to FIG. 5, a bushing 180 is seen to be provided within the dome-side swirler mounting opening 108. The bushing 180 includes a bushing opening 182 therethrough. The bushing 180 may be a cylindrical shaped spacer, and a height 184 of the bushing 180 is set so as to slidingly fit between a radially outer surface 186 of the outer flare axial wall 156 and a radially inner surface 188 of the outer axial wall 142 of the secondary swirler 124 (FIG. 4).

Figure 7:
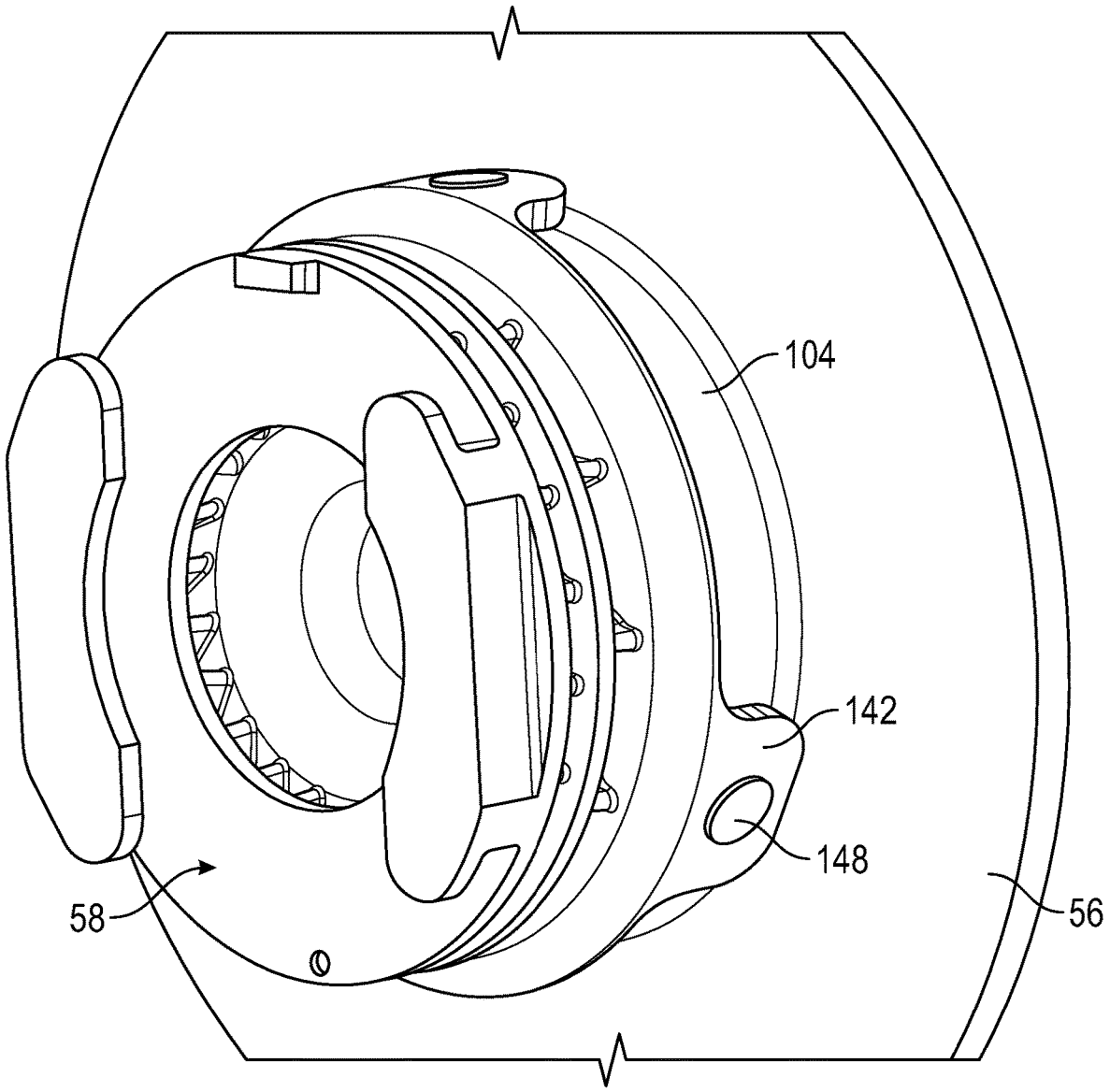
FIG. 7 is a forward aft-looking perspective view of a coupled swirler assembly and CMC dome, according to an aspect of the present disclosure.

FIG. 6 is a forward aft-looking perspective view of a decoupled swirler-CMC dome structure according to an aspect of the present disclosure. FIG. 7 is a forward aft-looking perspective view of a coupled swirler-CMC dome structure, according to an aspect of the present disclosure. In both FIGS. 6 and 7, only a portion of the CMC dome 56 is depicted, and as was described above, the CMC dome 56 extends circumferentially about the combustor axial centerline 112. In mounting the swirler assembly 58 to the CMC dome 56, a respective bushing 180 is inserted into each of the dome-side swirler mounting openings 108 of the CMC dome 56. Referring back to FIG. 5, the swirler assembly 58 is then inserted onto the CMC dome 56 by arranging each of the respective ones of the plurality of clevis dome attachment members 162 of the swirler assembly 58 with respective ones of the bushings 180, with the flare end wall radial surface 178 engaging with the shoulder 110 of the CMC dome 56 (FIG. 5). Each of the outer axial wall opening 146, the bushing opening 182, and the outer flare axial wall opening 160 is radially aligned, and the swirler-dome connecting member 148 (FIG. 4) is inserted through each of the openings (146, 182, 160) until a head 190 of the swirler-dome connecting member 148 engages with the recess portion 152 of the outer axial wall opening 146. The head 190 may then be connected (e.g., brazed) to the outer axial wall 142. Thus, as seen in FIG. 7, the swirler assembly 58 can be coupled to the CMC dome 56, but is coupled in a manner that thermally decouples the CMC dome 56 from the swirler assembly 58 in order to accommodate thermal expansion differences between the metallic swirler assembly 58 and the CMC dome 56. In addition, the swirler-dome connecting members 148, while not being fully constrained by the CMC dome 56, nonetheless restrain rotation of the swirler assembly 58 about the swirler mounting wall 104, but allow for some axial movement of the swirler assembly 58 that is constrained by the shoulder 110 (FIG. 6) of the CMC dome 56.

While the foregoing description relates generally to a gas turbine engine, it can readily be understood that the gas turbine engine may be implemented in various environments. For example, the engine may be implemented in an aircraft, but may also be implemented in non-aircraft applications, such as power generating stations, marine applications, or oil and gas production applications. Thus, the present disclosure is not limited to use in aircraft.

Further aspects of the present disclosure are provided by the subject matter of the following clauses.

A combustor for a gas turbine, the combustor comprising: a ceramic matrix composite (CMC) dome including (a) swirler assembly opening through the CMC dome, and (b) a swirler mounting wall extending from an upstream side of the CMC dome and having a plurality of dome-side swirler assembly mounting openings therethrough; a swirler assembly including a plurality of clevis dome attachment members for connecting the swirler assembly to the CMC dome; a plurality of bushings having an opening therethrough arranged within respective ones of the plurality of dome-side swirler assembly mounting openings; and a plurality of swirler-dome connecting members, wherein the swirler assembly is connected to the CMC dome via respective ones of the plurality of clevis dome attachment members engaging respective ones of the plurality of dome-side swirler assembly mounting openings in which respective ones of the plurality of bushings are arranged therein, and respective ones of the plurality of swirler-dome connecting members are arranged through respective ones of the clevis dome attachment members, and respective ones of the plurality of bushings.

The combustor according to any preceding clause, wherein the plurality of swirler-dome connecting members restrain the swirler assembly from rotating about the swirler mounting wall.

The combustor according to any preceding clause, wherein the plurality of clevis dome attachment members comprises between two and four clevis dome attachment members circumferentially spaced about a swirler centerline axis of the swirler assembly.

The combustor according to any preceding clause, wherein the combustor defines a combustor axial centerline along a combustor longitudinal direction, a combustor radial direction extending outward from the combustor axial centerline, and a combustor circumferential direction extending circumferentially about the combustor axial centerline, and the CMC dome extends circumferentially about the combustor axial centerline.

The combustor according to any preceding clause, wherein each clevis dome attachment member including a clevis outer portion and a clevis inner portion.

The combustor according to any preceding clause, wherein the clevis outer portion is defined by a secondary swirler of the swirler assembly, and the clevis inner portion is defined by a flare connected to the secondary swirler.

The combustor according to any preceding clause, wherein each of the plurality of swirler-dome connecting members comprises a pin.

The combustor according to any preceding clause, wherein each pin is joined to the clevis outer portion.

The combustor according to any preceding clause, wherein the swirler assembly opening of the CMC dome defines a CMC opening centerline therethrough defining a CMC opening longitudinal direction, a CMC opening radial direction extending outward from the CMC opening centerline, and a CMC opening circumferential direction extending circumferentially about the CMC opening centerline, the swirler mounting wall extending circumferentially about the CMC opening centerline and extending upstream in the CMC opening longitudinal direction from the upstream side of the CMC dome.

The combustor according to any preceding clause, wherein the plurality of dome-side swirler assembly mounting openings extend in the CMC opening radial direction.

The combustor according to any preceding clause, wherein the swirler assembly defines a swirler centerline therethrough that defines a swirler longitudinal direction, a swirler radial direction extending outward from the swirler centerline, and a swirler circumferential direction extending circumferentially about the swirler centerline, the swirler assembly comprising (a) a primary swirler, and (b) a secondary swirler connected to a downstream side of the primary swirler.

The combustor according to any preceding clause, wherein the secondary swirler includes a downstream radial wall extending circumferentially about the swirler centerline, and a flare connecting wall extending circumferentially about the swirler centerline and extending downstream in the swirler longitudinal direction from a radially inner end of the downstream radial wall.

The combustor according to any preceding clause, wherein the secondary swirler includes a plurality of outer axial walls extending downstream in the swirler longitudinal direction from a radially outer end of downstream radial wall, each outer axial wall having an outer axial wall opening therethrough extending in the swirler radial direction, each respective outer axial wall defining a clevis outer portion of a respective clevis dome attachment member.

The combustor according to any preceding clause, wherein the swirler assembly comprises a flare connected to the flare connecting wall of the secondary swirler, and including (i) a flare end wall extending radially outward from a downstream end of a flare inner axial wall and extending circumferentially about the swirler centerline, and (ii) a plurality of outer flare axial walls, each outer flare axial wall extending upstream in the swirler longitudinal direction from a radially outer end of the flare end wall, and including an outer flare axial wall opening therethrough extending in the swirler radial direction, each outer flare axial wall defining a clevis inner portion of a respective clevis dome attachment member.

The combustor according to any preceding clause, wherein the CMC dome comprises a shoulder extending in the CMC opening radial direction between the swirler assembly opening and the swirler mounting wall.

The combustor according to any preceding clause, wherein a radially outer end of the flare end wall includes a step that extends circumferentially about the swirler centerline, and forms a flare end wall radial surface, the flare end wall radial surface engaging with the shoulder of the CMC dome.

The combustor according to any preceding clause, wherein the flare comprises a conical wall defining an outlet of the swirler assembly, the conical wall extending through the swirler opening into a combustion chamber beyond a downstream surface of the CMC dome.

The combustor according to any preceding clause, wherein the CMC dome includes a plurality of swirler assembly openings circumferentially spaced in the combustor circumferential direction, each respective one of the plurality of swirler assembly openings having a respective swirler mounting wall.

The combustor according to any preceding clause, comprising a plurality of the swirler assemblies connected to the CMC dome.

The combustor according to any preceding clause, wherein each respective swirler assembly is connected to the CMC dome via respective ones of the plurality of clevis dome attachment members engaging respective ones of the plurality of dome-side swirler assembly mounting openings in which respective ones of the plurality of bushings are arranged therein, and respective ones of the plurality of swirler-dome connecting members are arranged through respective ones of the clevis dome attachment members, and respective ones of the plurality of bushings.

Although the foregoing description is directed to some exemplary embodiments of the present disclosure, other variations and modifications will be apparent to those skilled in the art, and may be made without departing from the spirit or scope of the disclosure. Moreover, features described in connection with one embodiment of the present disclosure may be used in conjunction with other embodiments, even if not explicitly stated above.

We claim:

1. A combustor for a gas turbine, the combustor comprising:

a ceramic matrix composite (CMC) dome including (a) swirler assembly opening through the CMC dome, and (b) a CMC swirler mounting wall formed integral with the CMC dome and extending from an upstream side of the CMC dome and having a plurality of dome-side swirler assembly mounting openings therethrough;

a swirler assembly including a plurality of clevis dome attachment members for connecting the swirler assembly to the CMC dome;

a plurality of bushings having an opening therethrough arranged within respective ones of the plurality of dome-side swirler assembly mounting openings; and a plurality of swirler-dome connecting members, wherein the swirler assembly is connected to the CMC dome via respective ones of the plurality of clevis dome attachment members engaging respective ones of the plurality of dome-side swirler assembly mounting openings in which respective ones of the plurality of bushings are arranged therein, and respective ones of the plurality of swirler-dome connecting members are arranged through respective ones of the clevis dome attachment members, and respective ones of the plurality of bushings.

2. The combustor according to claim 1, wherein the plurality of swirler-dome connecting members restrain the swirler assembly from rotating about the CMC swirler mounting wall.

3. The combustor according to claim 1, wherein the plurality of clevis dome attachment members comprises between two and four clevis dome attachment members circumferentially spaced about a swirler centerline axis of the swirler assembly.

4. The combustor according to claim 1, wherein the combustor defines a combustor axial centerline along a combustor longitudinal direction, a combustor radial direction extending outward from the combustor axial centerline, and a combustor circumferential direction extending circumferentially about the combustor axial centerline, and the CMC dome extends circumferentially about the combustor axial centerline.

5. The combustor according to claim 4, wherein the CMC dome includes a plurality of swirler assembly openings circumferentially spaced in the combustor circumferential direction, each respective one of the plurality of swirler assembly openings having a respective CMC swirler mounting wall.

6. The combustor according to claim 5, comprising a plurality of the swirler assemblies connected to the CMC dome.

7. The combustor according to claim 6, wherein each respective swirler assembly is connected to the CMC dome via respective ones of the plurality of clevis dome attachment members engaging respective ones of the plurality of dome-side swirler assembly mounting openings in which respective ones of the plurality of bushings are arranged therein, and respective ones of the plurality of swirler-dome connecting members are arranged through respective ones of the clevis dome attachment members, and respective ones of the plurality of bushings.

8. The combustor according to claim 1, wherein each clevis dome attachment member includes a clevis outer portion and a clevis inner portion.

9. The combustor according to claim 8, wherein the clevis outer portion is defined by a secondary swirler of the swirler assembly, and the clevis inner portion is defined by a flare connected to the secondary swirler.

10. The combustor according to claim 8, wherein each of the plurality of swirler-dome connecting members comprises a pin.

11. The combustor according to claim 10, wherein each pin is joined to the clevis outer portion.

12. The combustor according to claim 1, wherein the swirler assembly opening of the CMC dome defines a CMC opening centerline therethrough defining a CMC opening longitudinal direction, a CMC opening radial direction extending outward from the CMC opening centerline, and a CMC opening circumferential direction extending circumferentially about the CMC opening centerline, the CMC swirler mounting wall extending circumferentially about the CMC opening centerline and extending upstream in the CMC opening longitudinal direction from the upstream side of the CMC dome.

13. The combustor according to claim 12, wherein the plurality of dome-side swirler assembly mounting openings extend in the CMC opening radial direction.

14. The combustor according to claim 13, wherein the swirler assembly defines a swirler centerline therethrough that defines a swirler longitudinal direction, a swirler radial direction extending outward from the swirler centerline, and a swirler circumferential direction extending circumferentially about the swirler centerline, the swirler assembly comprising (a) a primary swirler, and (b) a secondary swirler connected to a downstream side of the primary swirler.

15. The combustor according to claim 14, wherein the secondary swirler includes a downstream radial wall extending circumferentially about the swirler centerline, and a flare connecting wall extending circumferentially about the swirler centerline and extending downstream in the swirler longitudinal direction from a radially inner end of the downstream radial wall.

16. The combustor according to claim 15, wherein the secondary swirler includes a plurality of outer axial walls extending downstream in the swirler longitudinal direction from a radially outer end of downstream radial wall, each outer axial wall having an outer axial wall opening therethrough extending in the swirler radial direction, each respective outer axial wall defining a clevis outer portion of a respective clevis dome attachment member.

17. The combustor according to claim 16, wherein the swirler assembly comprises a flare connected to the flare connecting wall of the secondary swirler, and including (i) a flare end wall extending radially outward from a downstream end of a flare inner axial wall and extending circumferentially about the swirler centerline, and (ii) a plurality of outer flare axial walls, each outer flare axial wall extending upstream in the swirler longitudinal direction from a radially outer end of the flare end wall, and including an outer flare axial wall opening therethrough extending in the swirler radial direction, each outer flare axial wall defining a clevis inner portion of a respective clevis dome attachment member.

18. The combustor according to claim 17, wherein the CMC dome comprises a shoulder extending in the CMC opening radial direction between the swirler assembly opening and the CMC swirler mounting wall.

19. The combustor according to claim 18, wherein a radially outer end of the flare end wall includes a step that extends circumferentially about the swirler centerline, and forms a flare end wall radial surface, the flare end wall radial surface engaging with the shoulder of the CMC dome.

20. The combustor according to claim 19, wherein the flare comprises a conical wall defining an outlet of the swirler assembly, the conical wall extending through the swirler assembly opening into a combustion chamber beyond a downstream surface of the CMC dome.

* * * * *